US008215497B1

(12) United States Patent
Marchalonis

(10) Patent No.: US 8,215,497 B1
(45) Date of Patent: Jul. 10, 2012

(54) COLLAPSIBLE STAND

(76) Inventor: Robert Bernard Marchalonis, Lancaster, PA (US)

( * ) Notice: Subject to any disclaimer, the term of this patent is extended or adjusted under 35 U.S.C. 154(b) by 0 days.

(21) Appl. No.: 13/099,439

(22) Filed: May 3, 2011

(51) Int. Cl.
*A47F 7/00* (2006.01)

(52) U.S. Cl. ..... 211/14

(58) Field of Classification Search ..... 211/1, 14, 211/27, 71.01, 85.15, 85.23, 85.31, 181.1, 211/182; D11/128, 127, 125; D6/450, 453, D6/452; 248/127, 146, 151, 165, 150
See application file for complete search history.

(56) References Cited

U.S. PATENT DOCUMENTS

| | | | | | |
|---|---|---|---|---|---|
| 40,155 | A | * | 10/1863 | Billings | 211/1 |
| 413,181 | A | * | 10/1889 | Greeley | 248/150 |
| 1,164,714 | A | * | 12/1915 | Gronlund | 248/150 |
| D50,279 | S | * | 2/1917 | Mohr | D11/153 |
| 1,806,631 | A | * | 5/1931 | Lasher | 211/14 |
| 3,525,440 | A | * | 8/1970 | Anderson | 211/14 |
| 4,901,959 | A | * | 2/1990 | Stage | 248/97 |
| 5,632,460 | A | * | 5/1997 | Strickland | 248/146 |
| 5,779,059 | A | * | 7/1998 | Kotch | 211/14 |
| 5,784,972 | A | * | 7/1998 | Emalfarb et al. | 108/156 |
| 6,238,260 | B1 | * | 5/2001 | Spindell | 446/72 |
| D444,411 | S | * | 7/2001 | Glaubitz | D11/128 |
| D445,356 | S | * | 7/2001 | Glaubitz | D11/128 |
| D445,357 | S | * | 7/2001 | Glaubitz | D11/128 |
| D445,720 | S | * | 7/2001 | Glaubitz | D11/128 |
| 6,364,258 | B1 | * | 4/2002 | Naranjo | 248/154 |
| 6,578,802 | B1 | * | 6/2003 | Thier | 248/151 |
| 6,863,250 | B2 | * | 3/2005 | Nauseda et al. | 248/150 |
| 6,895,712 | B2 | * | 5/2005 | Gunderman et al. | 47/39 |
| 6,918,563 | B2 | * | 7/2005 | Tseng | 248/146 |
| D520,405 | S | * | 5/2006 | Prebil | D11/125 |
| D591,530 | S | * | 5/2009 | Giovanazzi | D6/450 |
| D630,904 | S | * | 1/2011 | Zeilinger | D7/628 |
| 2005/0145760 | A1 | * | 7/2005 | Bower et al. | 248/146 |
| 2009/0121108 | A1 | * | 5/2009 | McFadden | 248/318 |

* cited by examiner

*Primary Examiner* — Darnell Jayne
*Assistant Examiner* — Stanton L Krycinski
(74) *Attorney, Agent, or Firm* — Steven O'Donnell

(57) ABSTRACT

A stand, separable into parts, that can support substantially spherical objects such as pumpkins, melons, or balls; or those somewhat conical objects such as planters which have a top circumference greater in size than its lower circumference (the "load") is disclosed. The stand includes a girdle that supports the load, at least two rigid leg segments that reversibly attach to the girdle, and, in a preferred embodiment, at least two rigid or semi-flexible arm segments also reversibly attached to the girdle. The body of the load is not pierced by the stand. When assembled, the stand combined with a load forms a vaguely humanoid structure. When not in use, the stand is capable of being disassembled and stored in a relatively compact form.

2 Claims, 3 Drawing Sheets

COLLAPSIBLE STAND

FIELD OF THE INVENTION

The subject matter of this application relates to decorative stands that support substantially spherical objects such as pumpkins, melons, or balls; or those somewhat conical objects such as planters which have a top circumference greater in size than its lower circumference, in a manner that is vaguely humanoid in appearance.

BACKGROUND

Many people do some degree of holiday decorating throughout the year. For some of these people, the decorating endeavor is quite extensive and requires large amounts of holiday-specific paraphernalia.

One of the holidays associated with extensive decorating is Halloween and some elaborately decorated residences can be found in most neighborhoods where Halloween is celebrated. Those people that decorate, will often decorate for more than one holiday. The amount of decorations used for a season will vary based on the decorator, but many people become serial accumulators of holiday decorations. For these people especially, the storage of these decorating items in the off-season is an increasing problem. Obviously, as more items are required, the space needed to store them when not in use increases.

Of all the symbols and items associated with Halloween, perhaps the most iconic is carved pumpkin. Often, whether to increase visibility of the pumpkin, or to place the pumpkin in a decorative context, the pumpkin is placed on some type of stand. Display stands that present pumpkins in a decorative manner are known in the art. U.S. Pat. No. 6,546,654 discloses a number of decorative pumpkin stands. Patents U.S. D444411, U.S. D445356, U.S. D445357, U.S. D445720, U.S. D520405, and U.S. D591530 also disclose different pumpkin stands.

Although decorative when in use, when not in use these stands are bulky and difficult to store.

SUMMARY

The subject matter of this application is a readily collapsible decorative stand for substantially spherical objects such as pumpkins, melons, or balls; or for somewhat conical objects such as planters which have a top circumference greater in size than its lower circumference, (the "load") that forms a vaguely humanoid structure. The stand can be quickly assembled and disassembled without tools. In its disassembled state, the stand requires comparatively little storage space.

The stand consists of a girdle portion that reversibly attaches to at least two leg portions and, in at least one preferred embodiment, also to at least two arm portions. When assembled, a load is placed onto the girdle so that the load suggests the torso and head of a humanoid structure. The leg portions are rigid, but the arm portions may be flexible, allowing the stand, in its assembled form, to suggest humorous, whimsical, or threatening postures.

In one preferred embodiment, smooth male attachment regions of the arms and legs can be reversibly coupled with smooth female attachment regions located on the outer surface of the girdle portion. If additional structural stability is desired, compatible male and female threads may be present on the male and female attachment regions, respectively, to additionally secure said arms and legs.

DETAILED DESCRIPTION OF THE INVENTION

Figure 1:
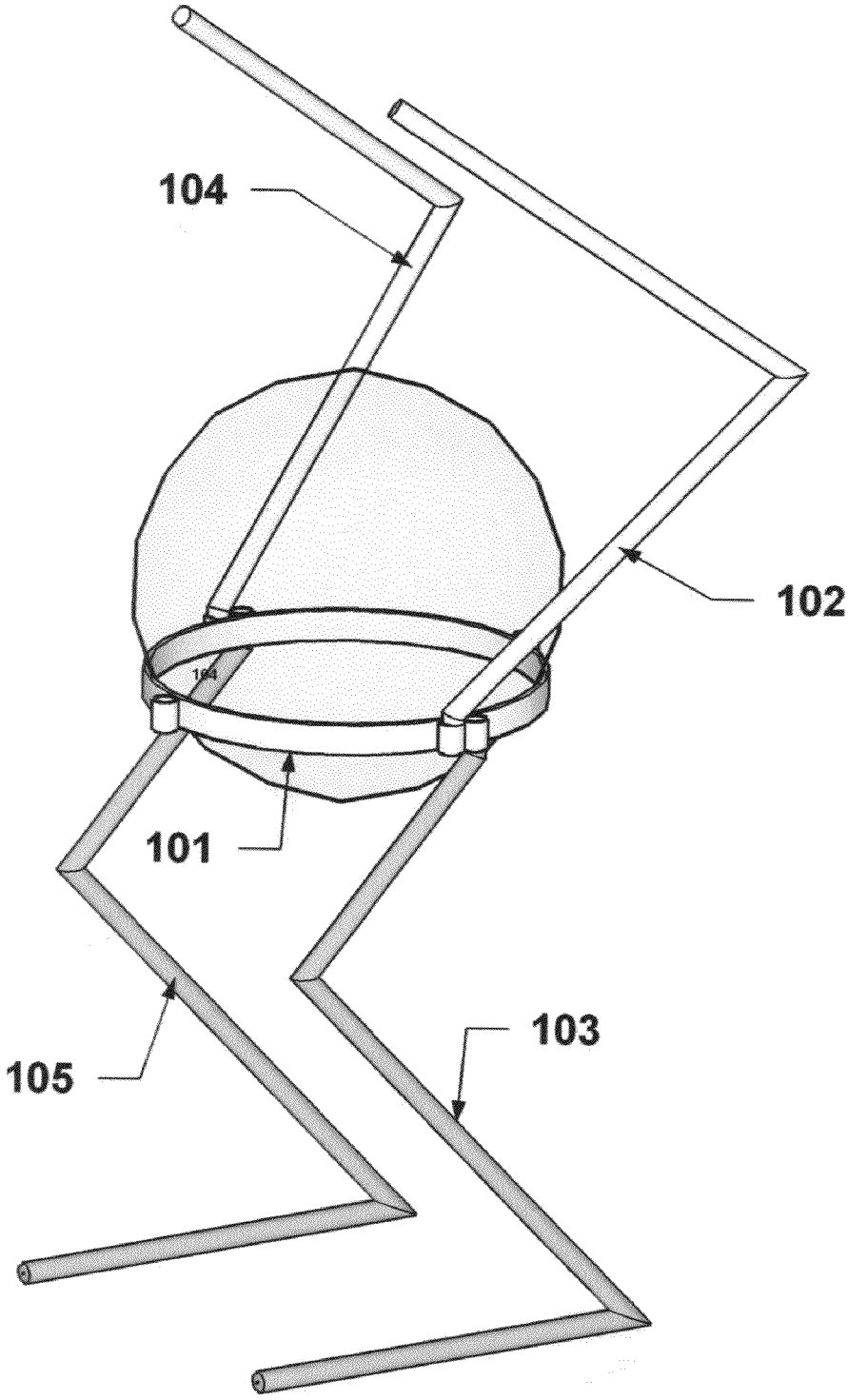
FIG. 1 is a perspective drawing of a preferred embodiment of the assembled stand disclosed in this application, the stand is further placed in context with the addition of a sphere representing a carved pumpkin as the stand might hold as a Halloween decoration.
Figure 2:
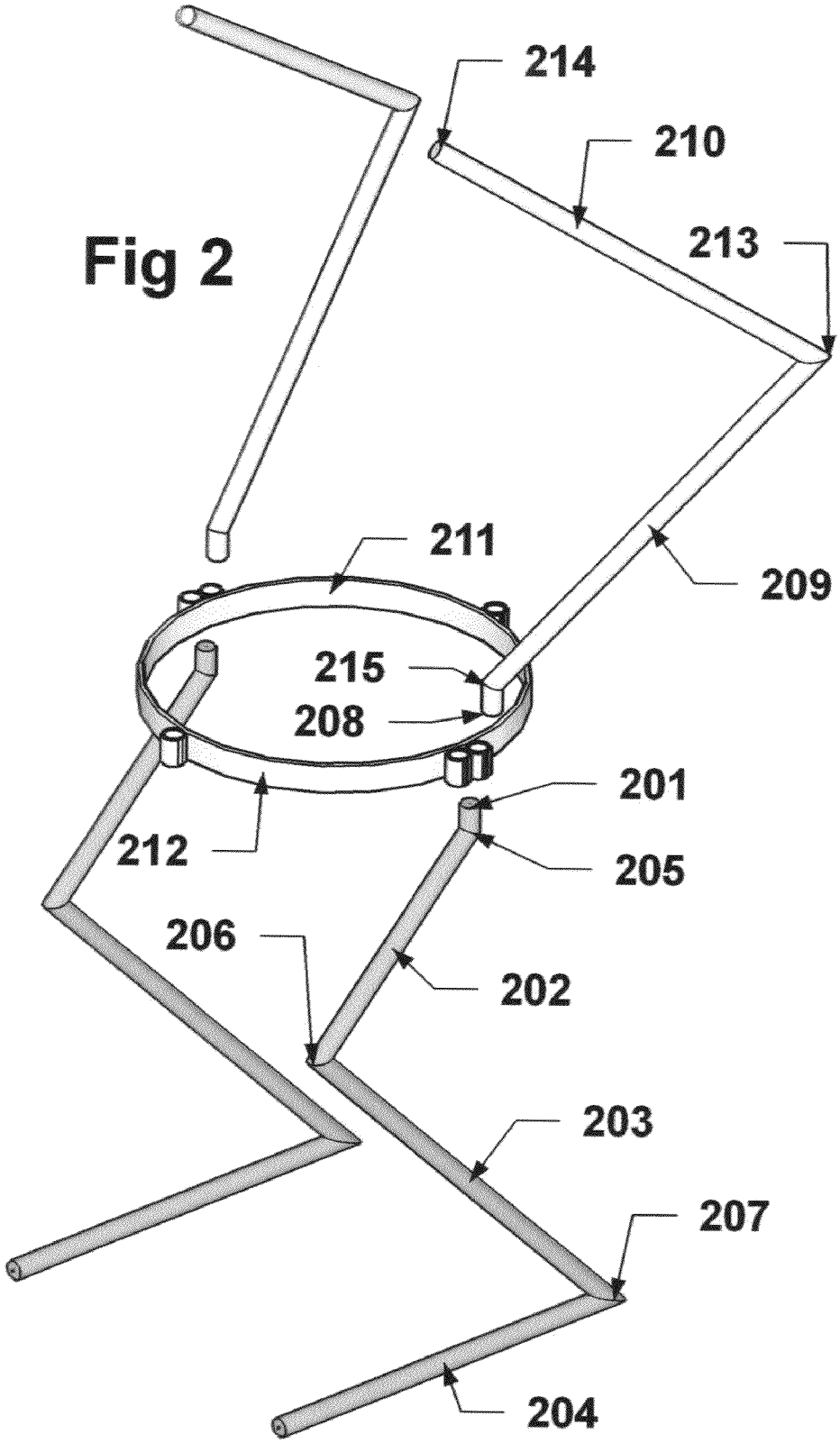
FIG. 2 is an exploded perspective drawing of this stand.
Figure 3:
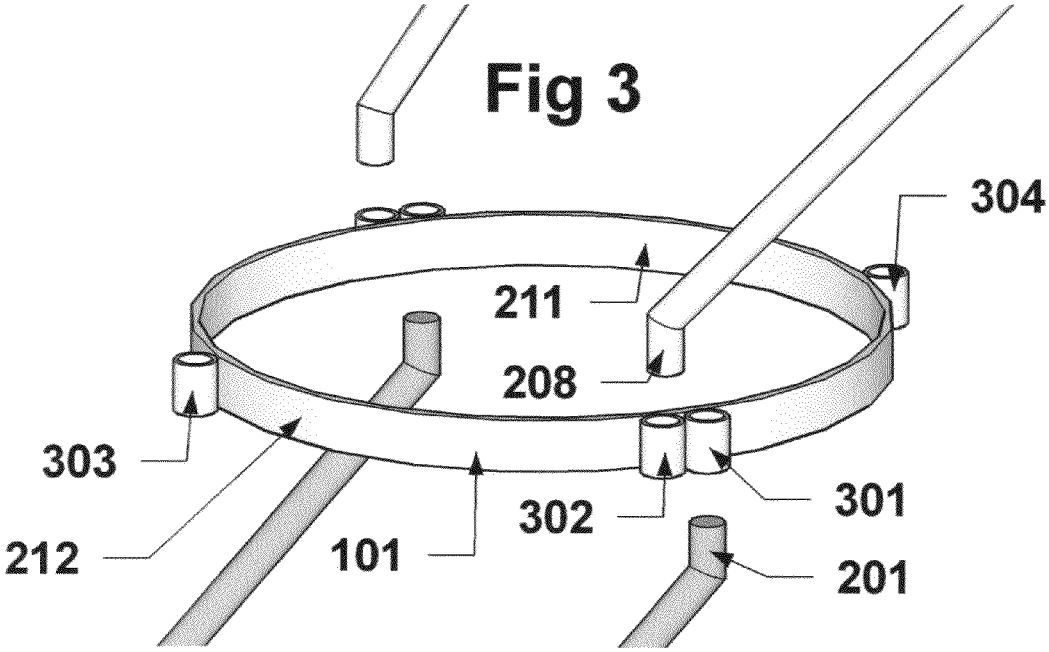
FIG. 3 is a drawing of the girdle portion showing how the girdle's attachment points interact with the attachment regions of the arm and right leg portions.

The following description and drawings referenced therein illustrate an embodiment of the application's subject matter. They are not intended to limit the scope. Those familiar with the art will recognize that other embodiments of the inventive concepts are possible. All such alternative embodiments should be considered within the scope of the invention.

Each reference number consists of three digits. The first digit corresponds to the figure number in which that reference number is first shown. Reference numbers are not necessarily discussed in the order of their appearance in the figures.

For convenience, the term "load" will be used in the following description, however that term should be understood to include any substantially spherical objects such as pumpkins, melons, or balls; or those somewhat conical objects such as planters which have a top circumference greater in size than its lower circumference.

The stand disclosed in this application is comprised of a girdle portion [101], at least two leg portions and, in preferred embodiments, at least two arm portions. In a most preferred embodiment, there are two arm portions [102 and 104], upwardly oriented from the girdle portion, that are reversibly attached to opposite sides of the girdle portion; similarly, in the most preferred embodiment, there are two leg portions [103 and 105], downwardly oriented from the girdle portion, that are reversibly attached to opposite sides of the girdle portion. In this embodiment, the positions of the two arm portions and two leg portions suggest a humanoid structure.

When the most preferred embodiment is assembled, the disclosed stand has a right and left side, with one leg portion and one arm portion located on the right side and one leg portion and one arm portion located on the left side. Although it is not necessary that the right and left leg portions, or the right and left arm portions, be exact mirror images of each other, to avoid duplication only a single arm, and a single leg portion will be described below. It should be understood that, unless specified, details given for a single arm or leg appendage correspond to both the right and left side variants.

The girdle portion [101] is a roughly circular shape having an outer [212] and an inner surface [211] so that it may support a load placed onto the girdle portion. Said girdle portion further comprises a number of attachment points [such as 301 and 302] that in a preferred embodiment are joined to the outer surface [212] although said attachment points may also be joined to the inner surface [211]. In the most preferred embodiment, there are four such attachment points [such as 301 and 302], two of these are located on the right side of said girdle portion (as viewed in an assembled stand) and the remaining two are located on the left side of said girdle portion. On both the right and left side of said girdle portion (as viewed in an assembled stand), one of the attachment points [either, e.g., 301 or 302] is intended to reversibly attach to that side's leg portion's attachment region [e.g. 201] and the other attachment point is intended to reversibly attach to that side's arm portion's attachment region [e.g. 208]. Although the preferred embodiment comprises a roughly circular girdle portion, said girdle portion may alternatively be in a hexagonal, pentagonal, triangular or other polygonal shape.

A leg portion consists of an attachment region [201], a thigh region [202], a calf region [203], and a foot region [204]. An angle [205] is formed by the attachment region and the thigh region [202]. An angle [206] is formed by the thigh region [202] and the calf region [203]. An angle [207] is formed by the calf region [202] and the foot region [204]. In most preferred embodiments, the angles [205, 206, and 207] are fixed so that when the stand is assembled, the leg portions are capable to supporting the weight of the stand itself and the stand when supporting a load. In the most preferred embodiment, the mass of the stand is distributed over the two leg portions so that the stand is does not tip either forward or backward when supporting a load. In an alternative embodiment, the angle [206] formed by the thigh region [202] and the calf region [203] may be 180 degrees. It such an alternative embodiment, descriptive terms such as "calf" and "thigh" might not apply since there may be no clear demarcation between the regions.

An arm portion consists of an attachment region [208], a bicep region [209], and a forearm region [210]. An angle [215] is formed by the attachment region [208] and the bicep region [209]. An angle [213] is formed by the bicep region [209] and the forearm region [210]. Those angles [215 and 213] may either be fixed or adjustable so as to allow the stand, in its assembled form, to suggest humorous, whimsical, or threatening postures. In an alternative embodiment the angle [213] is formed by the bicep region [209] and the forearm region [210] may be 180 degrees. In such an alternative embodiment, descriptive terms such as "bicep" and "forearm" might not apply since there may be no clear demarcation between the regions.

The girdle portion's [101] attachment points [such as 301 and 302] may be of any shape capable of accepting a corresponding attachment region, but are, in a preferred embodiment, a tubular material, such as a portion of pipe with an inner diameter large enough to reversibly accept the attachment regions of either a leg portion [201] or of an arm portion [208]. In this preferred embodiment, these attachment points are oriented so that they are perpendicular to the ground when the stand is assembled. When the stand is assembled, the said attachment regions of an arm portion [208] or of a leg portion [201] are held in conformation to the said girdle region's attachment points [e.g. 302 and 301] by the action of gravity. In the case of an arm portion's attachment region [208], gravity pushes the attachment region down into a said attachment point, until the angle [215] formed by the attachment region and the bicep region contacts the said attachment point (e.g. 302), preventing further downward movement of said arm portion. Similarly, in the case of an leg portion's attachment region [201], gravity pushes an attachment point (e.g. 301) down onto said leg portion's attachment region, until the angle [205] formed by the attachment region and the thigh region contacts the said attachment point, preventing further downward movement of said arm portion. In another preferred embodiment, the attachment regions of arm portions [208] or leg portions [201] further comprise male threads that correspond to female threads located in said girdle region's attachment points [such as 301 and 302].

In an alternative embodiment, accessory appendages may be reversibly attached to the girdle (e.g. the accessory attachment regions [303 and 304]) in the manners disclosed for the leg or arm portions to further enhance the decorative nature of the resulting humanoid figure. Such accessory appendages may include those resembling ears, wings, horns, wings, and other such decorative adjuncts; or may include appendages with functional aspects such as those holding a light or sound source, those holding signs, those equipped with motors, or other functional appendages.

I claim:

1. A stand for holding either substantially spherical objects such as pumpkins, melons, or balls; or those somewhat conical objects such as planters which have a top circumference greater in size than its lower circumference comprising:

a. a girdle portion that is substantially parallel to the ground when said stand is assembled, said girdle portion having an inner surface and an outer surface and being annular in shape when viewed from above said assembled stand, and two leg attachment points located on the outer surface of said girdle, so that the arrangement of said leg attachment points define a right and a left side of the girdle portion, said leg attachment points comprising tubular structures having an outer diameter and a substantially smooth inner diameter, said girdle portion further comprising at least one arm attachment point comprising a tubular structure having an outer diameter and a substantially smooth inner diameter, said arm attachment point being substantially adjacent to one of said leg attachment points on the outer surface of said girdle;

b. two or more leg portions, each said leg portion constructed from a rigid material and each having a foot region, a calf region, a thigh region, and a substantially smooth attachment region, further, each said leg portion consists of an ankle angle between said foot region and said calf region, a knee angle between said calf region and said thigh region, and a hip angle between said thigh region and said substantially smooth attachment region, each said leg portion attachment region being of a lesser diameter than the said girdle portion leg attachment internal diameter, so that a said leg portion attachment region can reversibly attach to a said girdle portion attachment point and form a stand that can support a load, the sum of the angles of said ankle angle, said knee angle and said hip angle are such that when said stand is assembled, said leg portions foot regions and said girdle portion are substantially parallel; and c. one or more arm portions, each said arm portion constructed from a rigid or semirigid material, and each having a forearm region, a biceps region, and a substantially smooth attachment region, further, each said arm portion consists of an elbow angle between said forearm region and said biceps region, and a shoulder angle between said biceps region and said substantially smooth attachment region, each said arm portion attachment region being of a lesser diameter than the said girdle portion leg attachment point internal diameter, so that a said arm portion attachment region can reversibly attach to said girdle portion attachment point and be supported by the stand when assembled.

2. The stand of claim 1, further comprising:

a. one or more auxiliary attachment points mounted to said girdle, said auxiliary attachment points being of similar construction to said leg attachment points or said arm attachment points, each having an inner diameter and an outer diameter, and being in addition to any said leg attachment points or any said arm attachment points;

b. one or more auxiliary limb portions, each having a substantially smooth attachment region and at least one other region, said attachment region of said auxiliary limb portion being of a lesser diameter than said auxiliary attachment point inner diameter so that said auxiliary limb reversibly attaches to said girdle auxiliary attachment point.

* * * * *